US008109104B2

(12) United States Patent
Doll, Jr. et al.

(10) Patent No.: US 8,109,104 B2
(45) Date of Patent: Feb. 7, 2012

(54) SYSTEM AND METHOD FOR DETECTING DECREASED PERFORMANCE IN A REFRIGERATION SYSTEM

(75) Inventors: Martin Luther Doll, Jr., York, PA (US); John C. Hansen, Spring Grove, PA (US)

(73) Assignee: York International Corporation, York, PA (US)

( * ) Notice: Subject to any disclaimer, the term of this patent is extended or adjusted under 35 U.S.C. 154(b) by 2026 days.

(21) Appl. No.: 10/926,155

(22) Filed: Aug. 25, 2004

(65) Prior Publication Data

US 2006/0042276 A1 Mar. 2, 2006

(51) Int. Cl.
*G01K 13/00* (2006.01)

(52) U.S. Cl. ..... 62/129; 62/149

(58) Field of Classification Search ..... 62/127, 62/129, 208, 201, 149
See application file for complete search history.

(56) References Cited

U.S. PATENT DOCUMENTS

| | | | | |
|---|---|---|---|---|
| 4,325,223 | A * | 4/1982 | Cantley | 62/126 |
| 4,510,576 | A | 4/1985 | MacArthur et al. | |
| 4,561,261 | A | 12/1985 | Kornrumpf et al. | |
| 4,768,346 | A | 9/1988 | Mathur | |
| 5,044,168 | A | 9/1991 | Wycoff | |
| 5,079,930 | A | 1/1992 | Beaverson et al. | |
| 5,083,438 | A | 1/1992 | McMullin | |
| 5,099,652 | A | 3/1992 | Iida et al. | |
| 5,239,865 | A | 8/1993 | Salzer et al. | |
| 5,301,514 | A | 4/1994 | Bessler | |
| 5,335,507 | A | 8/1994 | Powell | |
| 5,457,965 | A | 10/1995 | Blair et al. | |
| 5,481,884 | A | 1/1996 | Scoccia | |
| 5,586,445 | A | 12/1996 | Bessler | |
| 5,623,426 | A | 4/1997 | Ozawa et al. | |
| 5,623,834 | A | 4/1997 | Bahel et al. | |
| 5,761,916 | A | 6/1998 | Oswalt et al. | |
| 5,987,903 | A | 11/1999 | Bathla et al. | |
| 6,170,277 | B1 | 1/2001 | Porter et al. | |
| 6,209,338 | B1 * | 4/2001 | Thatcher, Jr. | 62/292 |
| 6,257,005 | B1 | 7/2001 | Beatty | |
| 6,272,868 | B1 | 8/2001 | Grabon et al. | |
| 6,293,114 | B1 | 9/2001 | Kamemoto | |
| 6,460,354 | B2 | 10/2002 | Yabuki et al. | |
| 2002/0173929 | A1 | 11/2002 | Seigel | |
| 2004/0111239 | A1 | 6/2004 | Rossi et al. | |

FOREIGN PATENT DOCUMENTS

| | | |
|---|---|---|
| JP | 2000-052754 | 2/2000 |
| JP | 2003-314933 | 11/2003 |

* cited by examiner

*Primary Examiner* — Cheryl J Tyler
*Assistant Examiner* — John Pettitt
(74) *Attorney, Agent, or Firm* — McNees Wallace & Nurick LLC

(57) ABSTRACT

Systems and methods are provided for detecting performance degradation in a refrigeration system. Specifically, the present invention provides systems and methods for detecting, at a very early stage, a low refrigerant charge and degradation in condenser performance of a refrigeration system.

4 Claims, 3 Drawing Sheets

SYSTEM AND METHOD FOR DETECTING DECREASED PERFORMANCE IN A REFRIGERATION SYSTEM

BACKGROUND OF THE INVENTION

The present invention relates generally to a system and method for detecting performance degradation in a refrigeration system. More specifically, the present invention relates to systems and methods for detecting, at a very early stage, a low refrigerant charge and degradation in condenser performance of a refrigeration system.

Compression refrigeration systems, including refrigeration, HVAC, and air conditioning systems (collectively hereinafter "refrigeration") may encounter degradation of performance resulting from the degradation of system components. For example, degradation of seals, piping, and component connections can lead to leakage of refrigerant. In addition to undesirable environmental hazards posed by refrigerant leakage, system performance and efficiency rapidly deteriorates from low refrigerant charge, resulting in energy inefficiency, as well as potential system shutdown and possible damage to system components. With respect to refrigeration systems employing condensers, degradation can occur as a result of a variety of factors such as debris blocking the airflow to the condenser coil, non-condensables in the condenser, and condenser fan malfunction. Compressor degradation can result in an undesirable increase of condenser pressure over time, thereby adversely affecting system efficiency and performance.

Therefore what is needed is a system and method for detecting, at a very early stage, low refrigerant charge, as well as any degradation of performance of the condenser and related components of a refrigeration system.

SUMMARY OF THE INVENTION

A chiller system is provided, the system comprising a compressor, a condenser, and an evaporator interconnected by a refrigerant line and forming a closed refrigerant circuit. The system further includes a plurality of sensors for sensing system parameters and transmitting data signals to a control, the control having a microprocessor and computer-readable instructions for storing a reference map of data relating to system parameters, for receiving and processing data signals from the sensors, for comparing the processed data signals to the data of the reference map, for detecting a system defect based upon the compared data. The system further includes an interface board communicably connected to the control for generating at least one alert and transmitting the at least one alert to a user interface.

In a preferred system embodiment, the plurality of sensors include at least one sensor for gathering data relating to the refrigerant liquid line temperature, at least one sensor for gathering data relating to the discharge pressure of the compressor, thus enabling the system to detect a system defect involving low refrigerant charge. In another embodiment, the plurality of sensors further comprise at least one ambient temperature sensor and a leaving chilled liquid temperature sensor, and the detected system defect includes high discharge pressure relating to faulty performance of the condenser or a condenser-related component of the system.

In another embodiment, methods are provided for monitoring and control of system parameters in a chiller system, the method comprising the steps of: storing reference data relating to parameters associated with proper refrigerant charge at various load conditions; providing a plurality of sensors for gathering data concerning operating parameters associated with proper refrigerant charge; operating the chiller system and gathering data from the sensors relating to proper refrigerant charge at actual load conditions; comparing the gathered data from the sensors to the reference data; and generating a low refrigerant alert if the gathered data does not fall within a predetermined range of the corresponding reference data. In a preferred embodiment of the method, the reference data and gathered data are comprised of refrigerant line temperature and at least one of discharge pressure, condensing pressure, and condensing temperature.

In another embodiment of the methods of the invention, the method further includes the steps of: storing reference data relating to parameters associated with proper condenser performance at various load conditions and ambient temperatures; providing a plurality of sensors for gathering data concerning operating parameters associated with condenser performance; operating the chiller system and gathering data from the sensors relating to condenser performance at actual load conditions and ambient temperatures; comparing the gathered data from the sensors to the reference data; and generating a condenser fault alert if the gathered data does not fall within a predetermined range of the corresponding reference data.

One advantage of the present invention is that low refrigerant charge can be detected at a very early stage, allowing for repair of the system to fix the leak to avoid downtime, as well as potential damage to the system and its components.

Another advantage of the present invention is that degradation of the condenser and associated component and system performance can be detected at a very early stage, allowing for maintenance and repair to restore condenser and component performance to avoid inefficient operation due to decreased subcooling, as well as possible damage to the system and its components.

Yet another advantage is that the invention promotes more efficient operation of refrigeration systems by permitting early detection and repair of low refrigerant charge and condenser problems.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
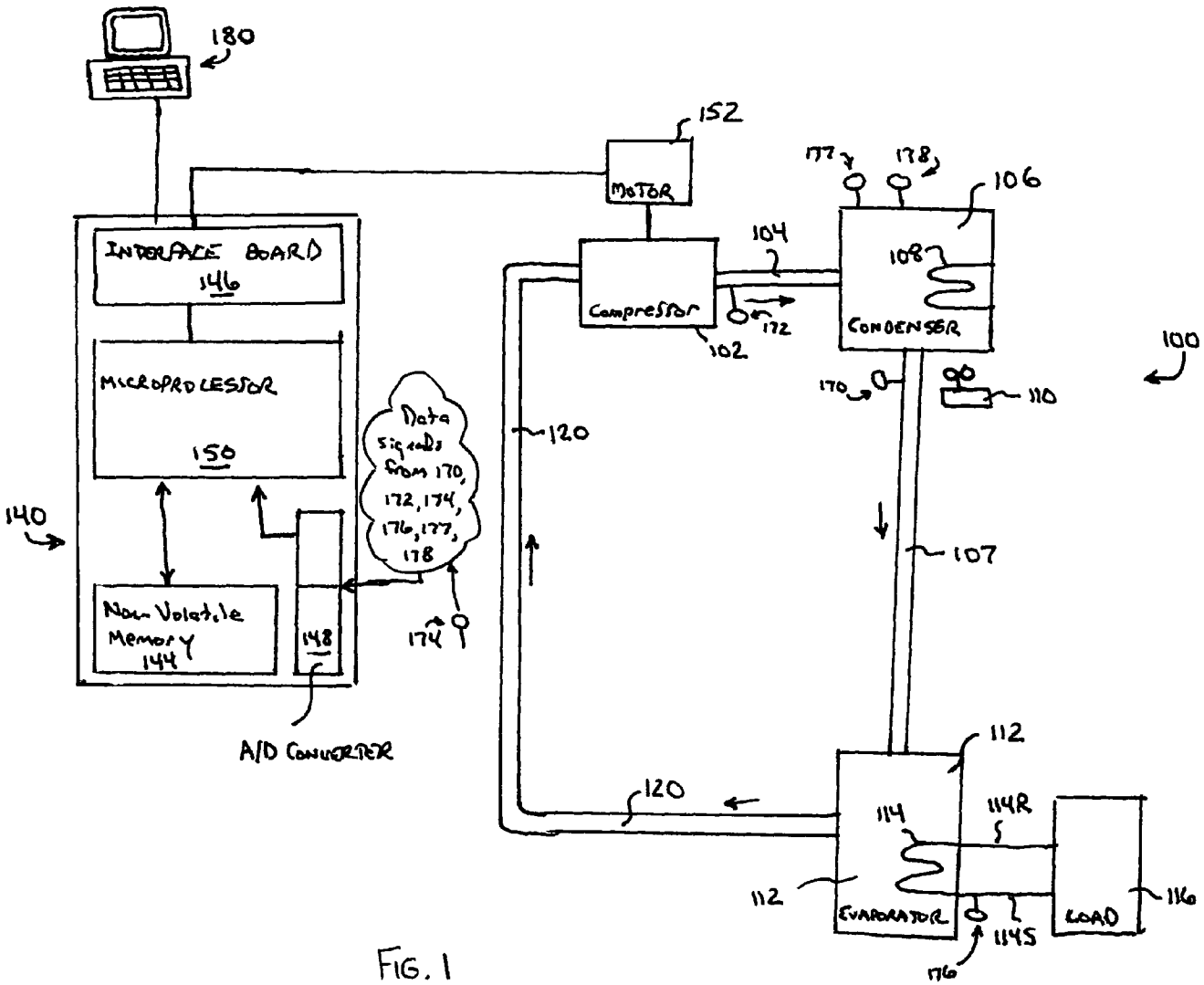
FIG. 1 illustrates schematically a refrigeration system of the present invention.

A general system to which the invention can be applied is illustrated, by means of example, in FIG. 1. As shown, the system 100, whether an HVAC, refrigeration, or liquid chiller system, includes a compressor 102, a condenser 106, a water chiller or evaporator 112, and a control panel 140. The control panel 140 can include an analog to digital (A/D) converter 148, a microprocessor 150, a non-volatile memory 144, and an interface board 146. The features and operation of the control panel 140 will be discussed in greater detail below. The conventional liquid chiller system 100 includes many other features that are not shown in FIG. 1. These features have been purposely omitted to simplify the drawing for ease of illustration.

Compressor 102 compresses a refrigerant vapor and delivers the vapor to the condenser 106 through a discharge line 104. The compressor 102 is preferably a centrifugal compressor, although other types of compressors including screw, scroll, and reciprocating compressors can be used. To drive the compressor 102, the system 100 includes a motor or drive mechanism 152 for compressor 102. While the term "motor" is used with respect to the drive mechanism for the compressor 102, it is to be understood that the term "motor" is not limited to a motor but is intended to encompass any component that can be used in conjunction with the driving of motor 152, such as a variable speed drive and a motor starter. In a preferred embodiment of the present invention, the motor or drive mechanism 152 is an electric motor and associated components. However, other drive mechanisms such as steam or gas turbines or engines and associated components can be used to drive the compressor 102.

The refrigerant vapor delivered by the compressor 102 to the condenser 106 enters into a heat exchange relationship with a fluid, e.g., air or water, and undergoes a phase change to a refrigerant liquid as a result of the heat exchange relationship with the fluid. The condensed liquid refrigerant from condenser 106 flows through an expansion device (not shown) to an evaporator 112. In a preferred embodiment, the refrigerant vapor in the condenser 106 enters into the exchange relationship with water, air, or another fluid, flowing through the secondary circuit of a heat-exchanger 108 or the condenser 106 and its coils can be cooled by air, and assisted by a condenser fan 110. The refrigerant vapor in the condenser 106 undergoes a phase change to a refrigerant liquid as a result of the heat exchange relationship with the water in the secondary circuit of the heat-exchanger 108 or the air passing through the condenser.

The evaporator 112 can be of any type, such as, but not limited to a shell and tube or coil-type evaporator. Preferably includes a heat-exchanger coil 114 having a supply line 114S and a return line 114R connected to a cooling load 116. The heat-exchanger coil 114 can include a plurality of tube bundles within the evaporator 112. A secondary liquid, which is preferably water, but can be any other suitable secondary liquid, e.g., ethylene, calcium chloride brine or sodium chloride brine, travels into the evaporator 112 via return line 114R and exits the evaporator 112 via supply line 114S. The liquid refrigerant in the evaporator 112 enters into a heat exchange relationship with the secondary liquid in the heat-exchanger coil 114 to chill the temperature of the secondary liquid in the heat-exchanger coil 114. The refrigerant liquid in the evaporator 112 undergoes a phase change to a refrigerant vapor as a result of the heat exchange relationship with the secondary liquid in the heat-exchanger coil 114. The vapor refrigerant in the evaporator 112 exits the evaporator 112 and returns to the compressor 102 by a suction line 120 to complete the cycle. While the system 100 has been described in terms of preferred embodiments for the condenser 106 and evaporator 112, it is to be understood that any suitable configuration of condenser 106 and evaporator 112 can be used in the system 100, provided that the appropriate phase change of the refrigerant in the condenser 106 and evaporator 112 is obtained.

The control panel 140 has an A/D converter 148 to preferably receive input signals from the system 100 that include data relating to performance parameters of various components of the system 100. For example, the input signals received by the control panel 140 can include the temperature and/or pressure of refrigerant in the compressor discharge line and the refrigerant liquid line, the leaving chilled liquid temperature from the evaporator 112, pressures and/or temperatures of refrigerant in the evaporator 112 and condenser 106, as well as ambient temperature of the environment of the installed system 100. Accordingly, the system 100 includes a plurality of sensors communicably linked to the control panel 140 for gathering data and relaying signals to the control panel 140 for processing.

In the particular embodiment of FIG. 1, the plurality of sensors include a refrigerant line temperature sensor 170 preferably located in immediate proximity to the condenser 106 liquid outlet, a discharge pressure transducer 172, an ambient temperature sensor 174, and a leaving chilled liquid sensor 176 located in the supply line 114S. In another embodiment, a condenser pressure transducer can be provided in place of the discharge pressure transducer 172. In still another embodiment, a condenser temperature sensor is provided in place of the condenser pressure transducer. In this embodiment, the condenser temperature sensor is provided in the condensing section of the condenser 106 so that it is in physical communication with the condensed refrigerant liquid. In such an embodiment, the condensing temperature can be converted, such as by the microprocessor 150, to a corresponding pressure using a refrigerant pressure-temperature algorithm.

The control panel 140 is communicably connected to each sensor, and is also preferably connected to an interface board 146 to transmit signals, whether by wired or wireless means, to a user interface or display 180. Optionally, the interface board 146 can further transmit signals to components of the system 100 to control the operation of the system 100, such as the speed of the motor, the position of any capacity control device, and the like. The control panel 140 may also include many other features and components that are not shown in FIG. 1. These features and components have been purposely omitted to simplify the control panel 140 for ease of illustration.

The control panel 140 uses one or more control algorithms to receive and process signals received from the various sensors of the system. In one embodiment, the control algorithm includes establishing and storing at least one operating map, such as in non-volatile memory 144, and preferably a family of operating maps, that can be used as a reference to determine whether the system 100 experiences any performance degradation over time. Preferably, the detected degradation in performance involves a detected loss of refrigerant charge, a faulty condenser 106 or related condenser component such as the condenser fan 110, or a combination of these factors.

The operating map includes stored data that can only be overwritten in limited circumstances. In a preferred embodiment, the stored data is contained in non-volatile memory 144 so as to prevent unintended or unauthorized deletion or overwriting of the data. In one embodiment, the stored data is preprogrammed and is derived from system design and testing under known conditions, such as in a controlled factory environment prior to installation. In another embodiment, the stored data is derived from actual system operation conducted during an initialization stage, preferably conducted immediately following installation of the system 100 in the field and operation of the system at specific operating conditions. Preferably, the initialization stage, and any subsequent data gathering, are preceded by at least a minimum operating period or interval so as to achieve stabilized system conditions. Initialization can also be performed upon restarting of the system after conducting significant repairs. In either embodiment, the system 100 allows for periodic re-populating of the stored data to correlate with actual system performance in the installed environment. For example, the control 140 of the system 100 may include password access or other security features that allow authorized personnel to run an initialization algorithm upon system installation, after system repairs, or following shutdown.

The stored data include data correlating to system 100 operation at full refrigerant charge, and with the condenser 106 functioning at factory specifications, at various loads and in various ambient conditions. Preferably, the stored data includes a reference map of all temperatures and/or pressures for a given load, and corresponds with the type of data to be gathered by each sensor provided in the system. Optionally, the data gathered from the sensors may be converted, such as by converting a temperature to a pressure, using known conversion algorithms, thereby enabling flexible use of sensor types (pressure transducers versus temperature thermistors) to obtain the most accurate data possible from each measured system parameter. Preferably, the reference map data further includes subcooling reference values that correspond to given conditions of load, ambient temperature, and measured pressure and/or temperature values. A subcooling value is defined herein as the difference between the temperature of the liquid leaving the condenser and the saturated discharge temperature or the saturated condensing temperature. A typical range of subcooling values for a fully charged system running at 100% capacity is about 10 to about 19 degrees Fahrenheit. Actual subcooling values may vary depending upon factors such as the selection and arrangement of system components such as compressor type, air versus water cooled chillers, and refrigerant selection including, but not limited to R-22, 407c, 410A or 134a, for example.

Once the system 100 is installed and the reference map data is stored, whether by using factory data or through an initialization process, the system 100 is operated. During system operation, the sensors of the system 100 generate and transmit signals containing data to the control 140. The microprocessor 150 of the control panel 140 runs at least one algorithm, including any conversion algorithms such as to convert sensed pressure to a calculated temperature or vice versa, to compare the received signal data to the corresponding preprogrammed data in the operating map. For example, at a given ambient temperature and load, the measured values of temperature or pressure received from each sensor are compared to the corresponding preprogrammed data for that given ambient temperature and load. If measured value of the received signal data falls within a preselected value or range or values stored in the reference map, no action is taken by the control 140. However, if the control algorithm determines that one or more of the received signal data falls outside of a preselected range of the corresponding reference map, a system defect is detected. If a system defect is detected, the control 140 preferably records and stores the data relating to the defect. More preferably, the control 140 generates a system alert. Most preferably, the system alert is also transmitted to maintenance personnel, such as by transmitting the alert to a user interface 180 communicably connected to the control 140. Additionally, if the signal data exceeds a preselected threshold, the control 140 can shut the system 100 down to avoid possible damage to system components.

In one embodiment, the control algorithm(s) can be computer programs stored in non-volatile memory 144 having a series of instructions executable by the microprocessor 150. While it is preferred that the control algorithm be embodied in a computer program(s) and executed by the microprocessor 150, it is to be understood that the control algorithm may be implemented and executed using digital and/or analog hardware by those skilled in the art. If hardware is used to execute the control algorithm, the corresponding configuration of the control panel 140 can be changed to incorporate the necessary components and to remove any components that may no longer be required, e.g. the A/D converter 148.

Using the system 100 of FIG. 1, a process is provided for determining a low refrigerant charge. The process begins by generating a reference map of data including subcooling values for the system over a range of system load conditions. As previously described, to obtain the initial reference map values for subcooling, the installed system 100 is preferably initialized by operating with a full refrigerant charge over a range of load conditions. In one embodiment, during initialization, the sensors of the system 100 measure: the refrigerant liquid line temperature using a refrigerant line temperature sensor 170; the discharge pressure using a discharge pressure transducer 172; and either the condensing pressure using a condensing pressure transducer 177, or the condensing temperature using a condensing temperature sensor 178. In embodiments using pressure transducers to measure discharge pressure and/or a condensing pressure transducer 170, the measured discharge pressure and/or condensing pressure can be converted to a corresponding refrigerant temperature using a refrigerant pressure-temperature algorithm. The subcooling values for various load conditions are then determined from the measured or measured and converted values, and are stored in the reference map.

Subsequently, during regular operation of the system 100 under given running conditions at a stabilized load 130, the actual subcooling of the operating system is determined based upon the measured values from signals generated by the sensors. Running condition factors for a given system 100 include, for example, ambient temperature, leaving chilled liquid temperature, percentage of full load, and condenser fan speed and status. The actual measured subcooling value for the stabilized load under the given running conditions is then compared to the corresponding reference subcooling value stored in the map for that given load under the given running conditions. If the determined subcooling value is less than the reference value or shows a trend of decreasing over time for the given load and running conditions, a low refrigerant charge state is determined, and a low refrigerant charge warning is generated and is preferably transmitted to the user display 180. In a preferred embodiment, each time the system 100 is run under a set of given running conditions and load, the control calculates and compares the actual subcooling value versus the reference value stored in the operating map for that set of conditions and load. A low refrigerant charge warning threshold is provided that is based on the comparison of the actual subcooling versus a reference subcooling value, the comparison expressed as a percentage of the reference subcooling value. Preferably, the low refrigerant charge warning threshold is adjustable, and is reached when the comparison of actual subcooling to a reference subcooling value is between about 90% to about 20%. More preferably, the warning threshold is reached when the comparison of actual subcooling to a reference subcooling value is between about 80% to about 25%. Most preferably, the warning threshold is reached when the comparison of actual subcooling to a reference subcooling value is between about 60% to about 30%. Preferably, the control also checks the actual subcooling value against a reference map containing the last previous actual subcooling value for the same set of running conditions and load, and generates a secondary low refrigerant charge warning if the actual subcooling value is less than about 80% of the last previous actual subcooling value for the same set of running conditions. More preferably, the secondary low refrigerant charge warning is generated if the actual subcooling value is less than between about 90% to about 75% of the last previous actual subcooling value for the same set of running conditions.

Additionally, in another embodiment, a shutdown threshold is provided to shut down the system to prevent damage to system components in the event of a substantial decrease in refrigerant charge. Preferably, the shutdown threshold is adjustable, and is reached when the comparison of actual subcooling to a reference subcooling value is less than about 40%. More preferably, the shutdown threshold is reached when the comparison of actual subcooling to a reference subcooling value is less than about 30%. Most preferably, the shutdown threshold can be adjusted by a user.

Similarly, the process for determining degradation in condenser 106 performance begins by providing, or generating through initialization, a reference map of discharge pressures (or condensing pressures) for the system 100 over a range of ambient temperatures, leaving chilled liquid temperatures, and system loads. In the initiation embodiment, to obtain each reference map, the system 100 is operated with a properly operating condenser 106 over a range of ambient temperatures, leaving chilled liquid temperatures, and system loads. With the system 100 operating, the ambient temperature (using the ambient temperature sensor 174), leaving chilled liquid temperature (using sensor 176), and the discharge pressure (using sensor 172) and/or the condensing pressure (using sensor 177) or condensing temperature (using sensor 178) are measured for a given load 116. It is to be noted that one skilled in the art can convert the measured pressures to corresponding saturated refrigerant temperatures for any given refrigerant. The measured values, or converted corresponding saturated refrigerant temperatures, are then stored in a reference map for each given set of system conditions. Subsequently, during regular operation of the system at a given load 116, ambient temperature and leaving chilled liquid temperature, the discharge pressure or condensing pressure of the system 100 is measured as described above. The measured pressure for the given load condition, ambient temperature and leaving chilled liquid temperature is then preferably converted to the corresponding saturated temperature for the given refrigerant used in the system, and is compared to the corresponding reference value for that given load, ambient temperature and leaving chilled liquid temperature. If the actual condensing pressure, or converted corresponding saturated temperature of the system 100 is greater than the reference value, or if the actual condensing pressure or converted saturated temperature shows a trend of increasing over time, for the given load, ambient temperature and leaving chilled liquid temperature, condenser performance is determined to be degrading. For example, an acceptable range of actual saturated refrigerant temperatures for a given refrigerant is between about 0 degrees F. to about +5 degrees F. above the reference temperature (for a water cooled condenser) to about 0 degrees F. to about +7 degrees F. above the reference temperature for an air cooled condenser. A poor condenser performance warning threshold would preferably be reached when the actual saturated temperature is greater than the reference temperature by about 6-9 degrees F. for a water cooled condenser system, and greater than the reference temperature by about 8-12 degrees F. for an air cooled condenser system. The control 140 preferably records the data relating to the breach of the threshold, and generates a high discharge pressure warning. Preferably, the warning is transmitted to a user interface 180, whether by wired or wireless means.

Additionally, in another embodiment, a shutdown threshold is provided to shut down the system to prevent damage to system components in the event of a substantial decrease in condenser performance. Preferably, the shutdown threshold is adjustable, and is reached when the comparison of actual saturated condensing temperature to a reference value is less than about 40%. More preferably, the shutdown threshold is reached when the comparison of actual saturated condensing temperature to a reference condensing temperature value is less than about 30%. The control 140 preferably records the data relating to the breach of the shutdown threshold, and generates a shutdown message. Preferably, the shutdown message is transmitted to a user interface 180, whether by wired or wireless means.

Figure 2:
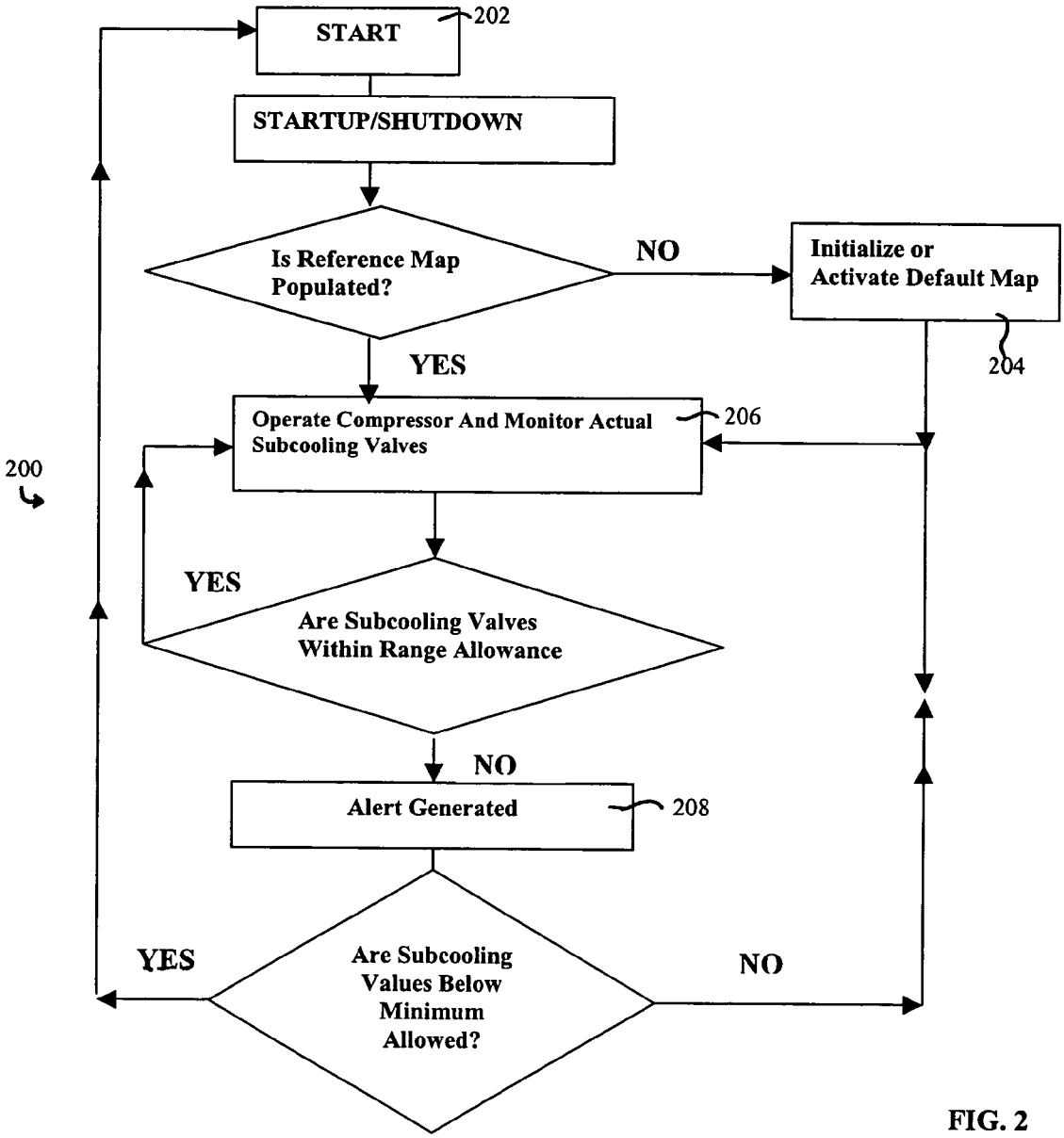
FIG. 2 illustrates a state diagram for the control system and method of the present invention for use with the refrigeration system illustrated in FIG. 1.
Figure 3:
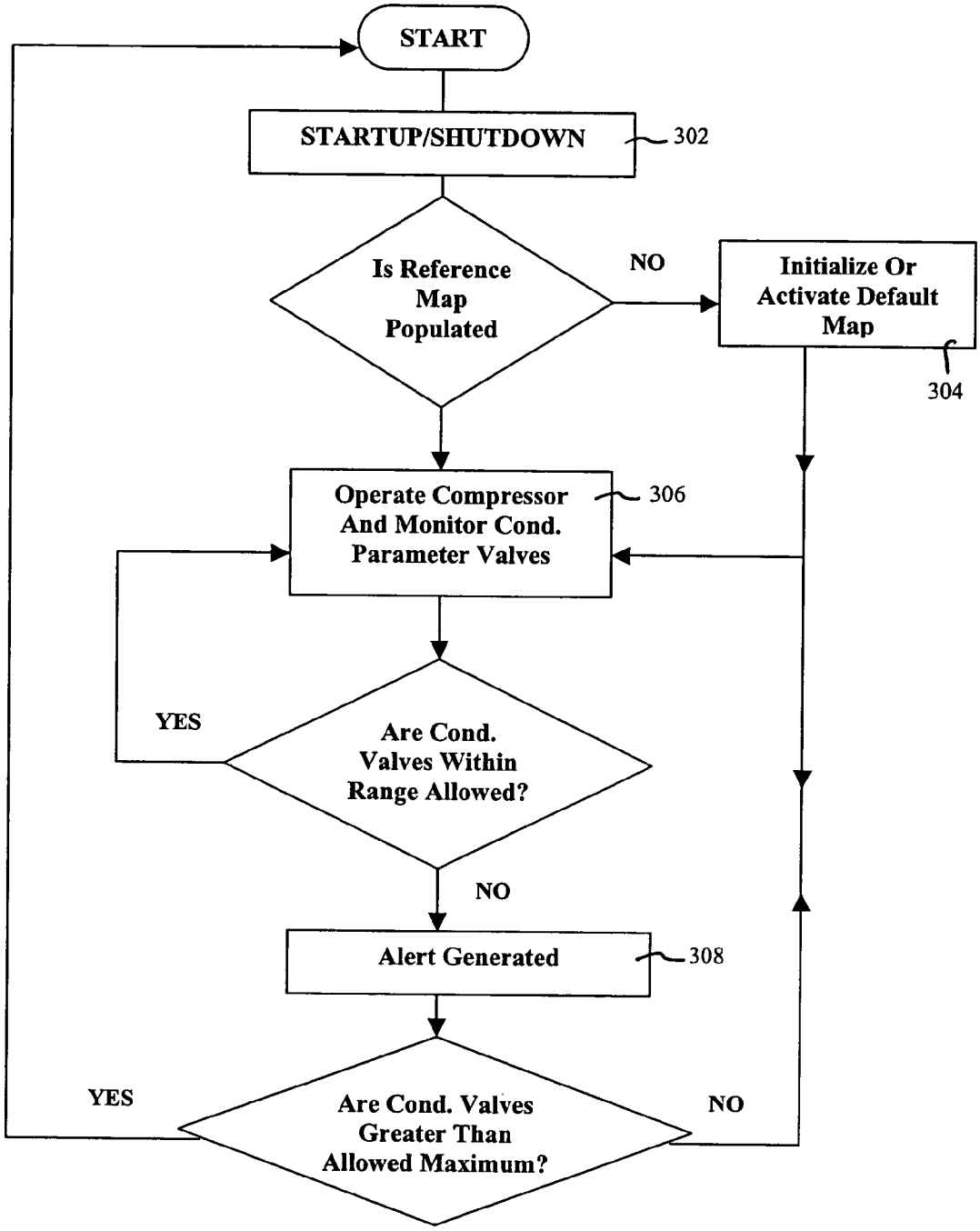
FIG. 3 illustrates another state diagram for the control system and method of the present invention for use with the refrigeration system illustrated in FIG. 1.

FIGS. 2 and 3 are state diagram representations of the preferred control algorithms of the present invention for establishing, storing, and utilizing operating maps to monitor refrigerant charge and condenser performance. The control algorithms may be executed as separate programs with respect to the other control algorithms for the system, e.g., the refrigerant charge control algorithm and the condenser performance algorithm, or can be incorporated into the other control algorithms of the system 100.

As shown in FIG. 2 a state diagram 200 for one embodiment of the refrigerant charge control algorithm of the present invention of FIG. 1 has four primary control states. The primary control states in this embodiment include: a startup/shutdown state 202, an initialization state 204, an operating state 206, and an alert state 208. The startup/shutdown state 202 is the first and last control state in the stability control algorithm 200. Upon starting or initiating the system 100 from an inactive state, the stability control algorithm 200 enters the startup/shutdown state 202. Similarly, when the system 100 is stopped or shutdown, the startup/shutdown state 202 is entered from any one of the other control states in the refrigerant charge control algorithm 200 in response to a shutdown command from another control algorithm controlling the system 100 or the refrigerant charge control algorithm 200. The refrigerant charge control algorithm 200 remains in the startup/shutdown state 202 until the compressor 108 is started. Once the compressor 108 is started, the control algorithm advances to the initialization state 204. During the initialization state 204, the control determines whether preprogrammed data are contained in the reference map, and whether the reference map needs to be initialized. If the reference map requires initialization, the system 100 preferably generates an alert to notify service personnel authorized to access the reference map and to initialize the system. In the interim, the initialization state preferably accesses a default map to allow system operation pending service. In this embodiment, the default map is preferably the last stored reference map, but may also be a map provided with factory preset values. In either embodiment, the use of the default map allows the algorithm to advance to the operating state 206. In the operating state 206, the sensors of the system gather data and transmit data signals to the control 140 for processing and comparison of measured values to the values in the reference map. If the measured values fall within a preselected range of values stored in the reference map for corresponding operating conditions, the system remains in the operating state 306. However, if the measured values fall outside of the preselected range, the algorithm advances to the alert state 208. In the alert state 208, the control preferably stores the measured values, and generates and transmits an alert message to a user interface, whether by wired or wireless means. Depending upon the measured values, the system may then return to the operating state 206, or may enter the startup/ shutdown state 202 to prevent possible damage to the system 100 resulting from operating with a low refrigerant charge.

FIG. 3 illustrates a preferred embodiment of the condenser performance algorithm 300 of the present invention. As shown in FIG. 3, a state diagram 300 for one embodiment of the condenser performance control algorithm of the present invention of FIG. 1 has four primary control states. The primary control states in this embodiment include: a startup/shutdown state 302, an initialization state 304, an operating state 306, and an alert state 308. The startup/shutdown state 302 is the first and last control state in the condenser performance control algorithm 300. Upon starting or initiating the system 100 from an inactive state, the control algorithm 300 enters the startup/shutdown state 302. Similarly, when the system 100 is stopped or shutdown, the startup/shutdown state 302 is entered from any one of the other control states in the condenser performance control algorithm 300 in response to a shutdown command from another control algorithm controlling the system 100 or the control algorithm 300. The condenser performance control algorithm 300 remains in the startup/shutdown state 302 until the compressor 108 is started. Once the compressor 108 is started, the control algorithm advances to the initialization state 304. During the initialization state 304, the control determines whether preprogrammed data are contained in the reference map, and whether the reference map needs to be initialized. If the reference map requires initialization, the system 100 preferably generates an alert to notify service personnel authorized to access the reference map and to initialize the system. In the interim, the initialization state 304 preferably accesses a default map to allow system operation pending service. In this embodiment, the default map is preferably the last stored reference map, but may also be a map provided with factory preset values. In either embodiment, the use of the default map allows the algorithm to advance to the operating state 306. In the operating state 306, the sensors of the system gather data and transmit data signals to the control 140 for processing and comparison of measured values to the values in the reference map. If the measured values fall within a preselected range of values stored in the reference map for corresponding operating conditions, the system remains in the operating state 306. However, if the measured values fall outside of the preselected range, the algorithm advances to the alert state 308. In the alert state 308, the control 140 preferably stores the measured values, and generates and transmits an alert message to a user interface 180, whether by wired or wireless means. Depending upon the measured values, the system may then return to the operating state 306, or may enter the startup/shutdown state 302 to prevent possible damage to the system 100 resulting from operating with a faulty condensor.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of detecting performance degradation in a refrigeration system, the method comprising:

initializing the refrigeration system by operating the refrigeration system with a full refrigerant charge at specific operating conditions, the specific operating conditions including a plurality of loads and a plurality of ambient conditions;

measuring initialization data relating to a plurality of operational parameters of the refrigeration system during the initialization of the refrigeration system;

storing the measured initialization data at the specific operating conditions;

operating the refrigeration system after initialization of the refrigeration system;

measuring operational data relating to at least one of the plurality of operational parameters at a particular operating condition of the operating refrigeration system;

comparing the measured operational data to the corresponding stored initialization data for the particular operating condition of the refrigeration system;

generating a low refrigerant charge alert upon the measured operational data being outside a predetermined range of the corresponding stored initialization data;

comparing currently measured operational data to previously measured operational data for the particular operating condition of the refrigeration system; and generating a low refrigerant charge alert upon the currently measured operational data showing a decreasing trend over time relative to the previously measured operational data.

2. The method of claim 1 wherein the step of generating a low refrigerant charge alert upon the currently measured operational data showing a decreasing trend over time relative to the previously measured operational data includes generating a low refrigerant charge alert upon the currently measured operational data being less than a predetermined percentage of the previously measured operational data.

3. The method of claim 2 wherein the predetermined percentage is between about 90% and about 75%.

4. A method of detecting performance degradation in a refrigeration system, the method comprising:

initializing the refrigeration system by operating the refrigeration system with a full refrigerant charge at specific operating conditions, the specific operating conditions including a plurality of loads and a plurality of ambient conditions;

measuring initialization data relating to a plurality of operational parameters of the refrigeration system during the initialization of the refrigeration system;

storing the measured initialization data at the specific operating conditions;

operating the refrigeration system after initialization of the refrigeration system;

measuring operational data relating to at least one of the plurality of operational parameters at a particular operating condition of the operating refrigeration system;

comparing the measured operational data to the corresponding stored initialization data for the particular operating condition of the refrigeration system;

generating a low refrigerant charge alert upon the measured operational data being outside a predetermined range of the corresponding stored initialization data;

storing condenser initialization data relating to a plurality of operational parameters of the refrigeration system associated with condenser performance at the specific operating conditions;

comparing the measured operational data to the corresponding stored condenser initialization data for the particular operating condition of the refrigeration system;

generating a condenser fault alert upon the measured operational data being outside a predetermined range of the corresponding stored condenser initialization data;

the plurality of operational parameters of the refrigeration system associated with condenser performance includes leaving liquid line temperature, and at least one of discharge pressure, condensing pressure, or condensing temperature;

the plurality of operational parameters of the refrigeration system associated with condenser performance comprises a saturated refrigerant temperature, and a maximum threshold of the predetermined range for the condenser fault alert is between about 6 degrees F. to about 12 degrees F. above the stored initialization data corresponding to the saturated refrigerant temperature;

comparing currently measured operational data corresponding to a saturated refrigerant temperature to previously measured operational data corresponding to a saturated refrigerant temperature for the particular operating condition of the refrigeration system; and generating a condenser fault alert upon the currently measured operational data corresponding to a saturated refrigerant temperature showing an increasing trend over time relative to the previously measured operational data corresponding to a saturated refrigerant temperature.

* * * * *